United States Patent [19]

Tanabe et al.

[11] 4,397,616

[45] Aug. 9, 1983

[54] PUMP DRIVING MECHANISM

[75] Inventors: Toshio Tanabe; Shinsaku Yasunaka, both of Osaka, Japan

[73] Assignee: Matsushita Electric Works, Ltd., Osaka, Japan

[21] Appl. No.: 253,525

[22] PCT Filed: May 9, 1980

[86] PCT No.: PCT/JP80/00098

§ 371 Date: Mar. 14, 1981

§ 102(e) Date: Mar. 12, 1981

[87] PCT Pub. No.: WO81/00288

PCT Pub. Date: Feb. 5, 1981

[30] Foreign Application Priority Data

Jul. 14, 1979 [JP] Japan ..... 54-97164[U]

[51] Int. Cl.[3] ..... F04B 9/02

[52] U.S. Cl. ..... 417/362; 417/415; 92/84; 92/137; 74/49

[58] Field of Search ..... 417/362, 410, 415; 74/49, 581, 599; 92/84, 137

[56] References Cited

U.S. PATENT DOCUMENTS

| | | | |
|---|---|---|---|
| 3,187,674 | 6/1965 | Hammelmann | 417/415 X |
| 3,365,796 | 1/1968 | Tolmie et al. | 30/43.92 |
| 3,425,410 | 2/1969 | Cammack | 417/415 X |
| 3,714,711 | 2/1973 | Daniels | 30/43.92 |
| 3,776,667 | 12/1973 | Berglund et al. | 417/454 |
| 4,030,573 | 6/1977 | Buzzi et al. | 30/43.92 |
| 4,065,977 | 1/1978 | Buzzi et al. | 74/49 |
| 4,167,060 | 9/1979 | Sakamoto | 30/43.92 |
| 4,312,126 | 1/1982 | Rochelt | 74/49 |

FOREIGN PATENT DOCUMENTS

| | | | |
|---|---|---|---|
| 53-88462 | 8/1978 | Japan . | |
| 935477 | 8/1963 | United Kingdom | 417/415 |

*Primary Examiner*—Leonard E. Smith

*Attorney, Agent, or Firm*—Burns, Doane, Swecker & Mathis

[57] ABSTRACT

A pump driving mechanism of this applications is formed by supporting a piston body 3 provided with a piston rod 9 and an elastic arm 18 movable in directions vertical to reciprocally moving directions of the piston body, between respective free ends of a pair of elastic leg pieces 16 and 17 fixed at one end and freed at the other end, and connecting an eccentric shaft 23 driven to be rotated by a motor 22 to a shaft bearing 21 formed at a free end of the elastic arm 18, whereby a low noise reciprocating movement within a cylinder 14 is provided to a piston rod 9 by rotations of the eccentric shaft 23.

8 Claims, 17 Drawing Figures

PUMP DRIVING MECHANISM

TECHNICAL FIELD

This invention relates to pump driving mechanisms and, more particularly, to a pump driving mechanism wherein a piston body provided with a shaft bearing part for a driving source is supported through elastic legs and the driving source is connected to the shaft bearing part to convert motions of the driving source to reciprocating motions.

BACKGROUND ART

Generally, in the pump driving mechanism, a pure reciprocating motion must be given to a piston to prevent water leakage and a contrivance to achieve that motion, such as a crank connection is required.

Therefore, in such conventional pump driving mechanisms as the one which has been adopted in a water feeding device 70 of, for example, FIG. 15, a driving force of an output shaft 72 of an electric motor 71 for a pump is transmitted to a driving gear 74 through a gear 73. An eccentric rotary motion of an eccentric pin 75 provided to project on the driving gear 74 is converted to a reciprocating motion through a slider 76 and piston joint 77, and a piston 78 is correctly driven to reciprocate within a cylinder 79. In such mechanism, however, a large noise has been generated when it is driven and the energy loss has been large for the following reasons. That is, there are seven places in which the respective elements slide in contact with each other, namely, between the eccentric pin 75 and the slider 76, between the slider 76 and the piston joint 77, between the piston joint 77 and the driving gear 74, between the slider 76 and the driving gear 74, between a piston rod 80 and a shaft bearing 81, between the gear 73 and the driving gear 74 and between the driving gear 74 and a reduction gear shaft 82 and the noise has been large.

DISCLOSURE OF THE INVENTION

Therefore, a first object of the present invention is to provide a pump driving mechanism wherein the sliding contacts are few and the noise upon the driving is low.

A second object of the present invention is to provide a pump driving mechanism wherein the size of the mechanism is minimized and the driving load is reduced.

A third object of the present invention is to provide a pump driving mechanism wherein vertical motions and rolling motions of the piston body in the reciprocating motion are prevented and any deterioration in performances due to a generation of clearance between the pison and the cylinder is prevented.

A fourth object of the present invention is to provide a pump driving mechanism of a thin type.

Other objects of the present invention will be gradually made clear by the following explanations with reference to embodiments.

Accordingly, in the present invention, a piston body is supported between respective free ends of a pair of elastic leg pieces fixed at one end and made free at the other end, a piston rod and shaft bearing part are formed in said piston body, an eccentric shaft driven to be rotated by a motor is connected to the shaft bearing part and the piston body is reciprocated, to thereby solve the foregoing conventional problems.

Further, in the present invention, the pair of elastic leg pieces are formed of U-shaped bent pieces and a substantial length of the elastic leg piece is secured within a limited space to attain the foregoing second object; the pair of U-shaped elastic leg pieces are folded back at half the entire length so as to cancel the rolling of the piston body by the both folded back pieces and to thereby provide a pure reciprocating motion to the piston body and attain the second and third objects; the pair of elastic leg pieces are connected with each other through connecting pieces and any nonuniform deflections of the respective elastic legs are eliminated to thereby attain the third object; an elastic arm movable in directions vertical to reciprocating directions of the piston body is provided with a shaft bearing and an eccentric shaft is inserted into the shaft bearing so that motions of the eccentric shaft in the direction intersecting at right angles the reciprocating motions of the piston will be absorbed by rocking motions of the elastic arm while the eccentric shaft and shaft bearing are round-hole-connected with each other to reduce noise generating sources to thereby attain the first object; and timing pulleys are connected through a timing belt to arrange the driving mechanism and driving source (motor) in parallel with each other to thereby attain the fourth object.

Explanations shall be made in the followings with reference to drawings showing embodiments of the present invention.

BRIEF EXPLANATION OF THE DRAWINGS

The drawings show embodiments of a pump driving mechanism of the present invention, in which:

In FIG. 1, a driver 1 is illustrated, which includes a pair of flange pieces 2 fixing the driver 1 to the pump device, and a piston body 3 is disposed between these fixing pieces 2. This piston body 3 is formed of a piston base 8 formed as a rectangle with respective pairs of elastic-leg bases 4 and 5 and supporting members 6 and 7 respectively provided to oppose each other and a cylindrical piston rod 9 projected on the side of the fixing piece 2 out of one of the elastic-leg bases 5.

In FIG. 2, the piston rod 9 is fixed by a stopper 13 on a shaft 10 provided in the center of the rod and inserted into a hole 11 formed in the elastic-leg base 5 and thereafter into a stopper-inserting hole 12 formed in the elastic-leg base 5. An end edge of this shaft 10 is fixed to the piston body 3 and forms a pump 15 together with a cylinder 14 (see FIG. 3). In FIG. 1, elastic leg pieces 16 and 17 are suspended respectively from the elastic-leg bases 4 and 5; their end edges are turned to be U-shaped again onto the side of the fixing pieces 2 and connected to the fixing pieces 2. Fixing piece side 16*a* and piston body side 16*b* as well as fixing piece side 17*a* and piston body side 17*b* are respectively formed to be of the same length. The elastic leg pieces 16 and 17 comprise widened and thined elastic plates and are formed to be higher in the elasticity than the fixing pieces 2, elastic-leg bases 4 and 5 and supporting members 6 and 7. An elastic arm 18 is provided as extended in parallel to the supporting members 6 and 7 toward the elastic-leg base 5 from the elastic-leg base 4 and is formed in a U-shape with elastic pieces 19 which are formed to be little flexible with respect to a compressive force in said extended direction but to be easily flexible with respect to a force from lateral sides and are connected with each other through a shaft bearing piece 20, while a shaft bearing 21 is formed at the center of the shaft bearing piece 20. Into this shaft bearing 21, an eccentric shaft 23 driven to be rotated by a motor 22 (see FIG. 11) is inserted. Fitting holes 24 are formed in the fixing pieces 2, and the driver 1 is fixed to a base 26 by screws 25 fitted in the fitting holes 24. The driver 1 is formed with a synthetic resin molding of such as a polyacetal resin so as to render the above referred elastic fixing pieces 2, piston body 3, elastic legs 16 and 17 and elastic arm 18 to be integral.

Further, the foregoing piston rod 9 is extended outward from the elastic-leg base 5 on the side of the extending direction of the elastic arm 18, whereby the moving directions of the piston body 3 in which the elastic arm 18 buckles coincide with the exhausting stroke of the piston body 3 in which the load of the pump is light so that the buckling of the elastic arm 18 will be prevented.

Figure 3A:
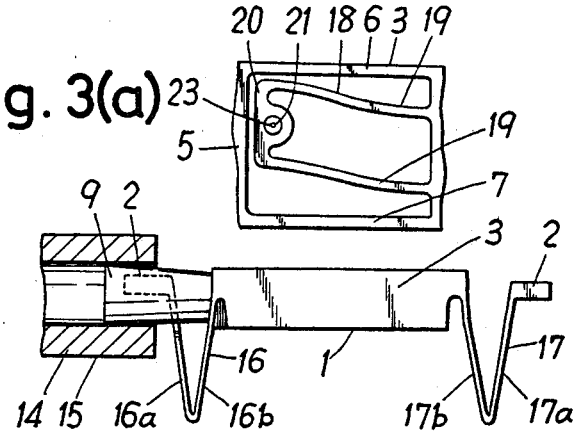
FIGS. 3*a*–3*c* show operational states.
Figure 3B:
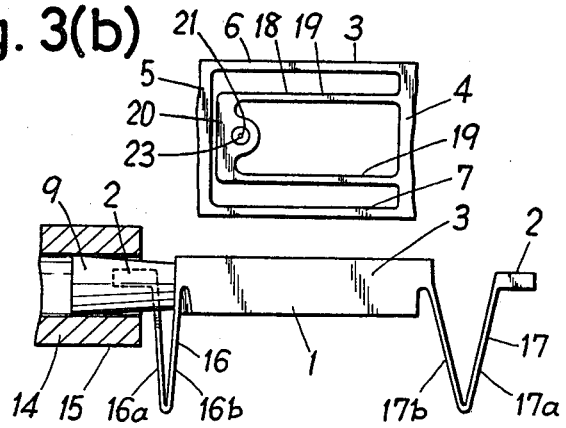
Figure 3C:
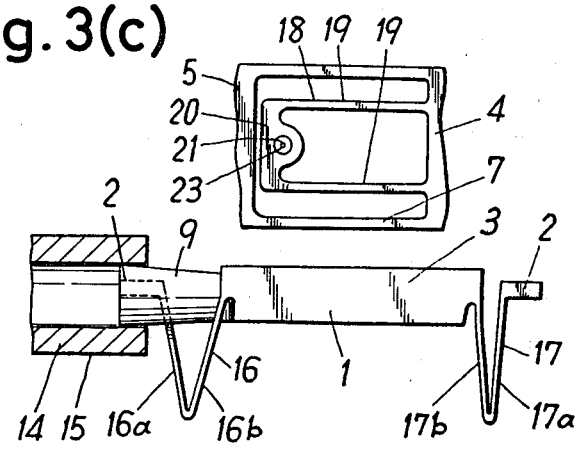

Operational states of the driver shall be explained next in the followings with reference to FIGS. 3(*a*), (*b*), and (*c*). FIG. 3(*a*) is a view of a state in which the eccentric shaft 23 inserted in the bearing 21 has approached the supporting member 6, wherein the pair of elastic leg pieces 16 and 17 are not deformed but the elastic pieces 19 of the elastic arm 18 are deformed as flexed to the side of the supporting member 6 with their elasticity. When the eccentric shaft 23 rotates from this state, as shown in FIG. 3(*b*), the elastic arm 18 will be deformed in response to the rotation of the eccentric shaft 23 and will come to the intermediate position between the supporting members 6 and 7. On the other hand, the elastic leg pieces 16 and 17 will be deformed, the piston body 3 will be made to approach the fixing piece 2 on the side of the piston rod 9 and the piston rod 9 will be inserted into the cylinder 14. When the eccentric shaft 23 further rotates from this state, the movement of the piston body 3 will turn responsive to the rotation of the eccentric shaft 23, the elastic pieces 19 of the elastic arm 18 will be deformed as flexed to the side of the supporting member 7 with their elasticity where the eccentric shaft 23 comes closer to the supporting member 7 but the pair of elastic leg pieces 16 and 17 are not deformed, thereafter the elastic pieces 19 of the elastic arm 18 will be deformed to separate from the fixing piece 2 on the side of the piston rod 9 and the piston rod 9 will retreat from the cylinder 14 as shown in FIG. 3(*c*). The eccentric shaft 23 rotates again to the state of FIG. 3(*a*) from this state of FIG. 3(*c*) and, with this rotation, the piston body 3 makes one reciprocating motion to complete the operation of one cycle. That is, the flexing directions of the elastic leg pieces 16 and 17 and elastic arm 18 are different so that the elastic leg pieces 16 and 17 will deform as bent in the reciprocating directions of the piston body 3 and the elastic pieces 19 of the elastic arm 18 will transmit reciprocating directional components in the rotational movements to the piston body 3 whereas, components in the directions perpendicular to the reciprocating directions, are in edgewise directions of the elastic leg pieces 16 and 17 of thin plates and the elastic leg pieces 16 and 17 are not deformed but the elastic pieces 19 are deformed as flexed to convert the rotary motions of the eccentric shaft 23 only into the parallel reciprocating motions of the piston body 3 so as to have the piston rod 9 reciprocally moved.

In the arrangement wherein, as has been referred to, the fixing pieces 2 and piston body 3 are connected by means of the elastic leg pieces 16 and 17 respectively formed integral with the fixing pieces 2 and piston body 3, the gears can be omitted in contrast to the conventional device referred to in the preamble so that the sliding places between the respective elements can be reduced and the drive can be made with a lower noise. Further, the U-shaped elastic leg pieces 16 and 17 can render the substantial length of the elastic leg pieces 16 and 17 to be larger within a limited space, whereby the driver 1 can be minimized in size, and any deformation load of the elastic leg pieces 16 and 17 per se is lowered so as to allow the piston body 3 to be reciprocally driven with a lower load. Further, the elastic leg pieces 16 and 17 connect the fixing pieces 2 and piston body 3 and are folded back at their centers to be a pair of U-shaped elastic leg pieces so as to have equal-length sides 16*a* and 17*a* and movable piece sides 16*b* and 17*b*. As a result, these fixing piece sides 16*a* and 17*a* and movable piece sides 16*b* and 17*b* of the respective elastic leg pieces 16 and 17 will flex by the same amount upon the reciprocal movements of the piston body 3 since their resistive moment are equal and the total height at the fixing piece side 16*a* of the elastic leg will be made lower by this flexure, but its contraction will be equal to the contraction of the total height at the movable piece side 16*b* of the elastic leg. Therefore, the folded-back parts will perform rocking movements. In the elastic leg 17, too, the contractions of the fixing piece side 17*a* and movable piece side 17*b* will be equal so that the folded-back parts will perform rocking movements and the rolling of the piston body 3 will be cancelled with the both folded-back pieces. Thus, the piston body 3 is caused to move parallelly and the movements of the piston rod 9 can be stabilized. The elastic leg pieces 16 and 17 are formed as beams of a uniform strength so as to render the stresses to be substantially equal over their total heights and total lengths, so that the maximum stress within the elastic leg pieces 16 and 17 can be made smaller. By varying the cross-sectional area over the total height or total length within the elastic leg pieces 16 and 17 or by varying the thickness and width of each leg piece, the stress within the elastic leg pieces 16 and 17 can be made smaller. Further, the piston body 3 to which the elastically flexible elastic arm 18 is fitted and in which the shaft bearing 21 is provided at the free end of the elastic arm 18, except the pivoting part between the elastic arm 18 and the eccentric shaft 23, is to utilize the elastic deformations of the elastic arm 18 and elastic leg pieces 16 and 17, so that any other motion component than the reciprocating motion can be absorbed by the elasticity of both of them or, specifically, by the elastic arm 18 and a very smooth reciprocating motion can be obtained. As the eccentric shaft 23 and bearing part 21 are round-hole-connected with each other, further, the clearance at the pivoting part can be kept always constant, whereby an effect that any vibrational noise is much lower can be obtained.

Figure 4:
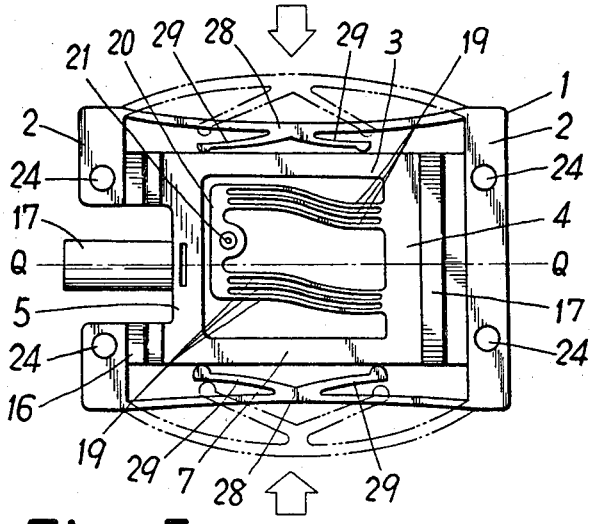
FIG. 4 is a plan view of another embodiment of the driver.
Figure 5:
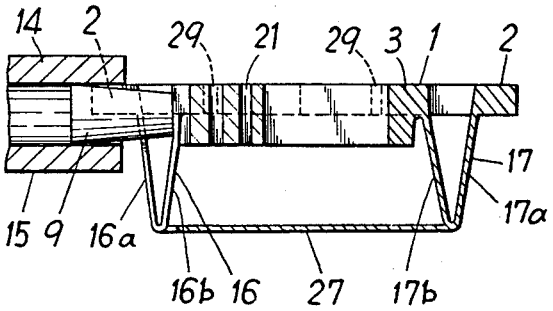
FIG. 5 is a sectioned view on line Q—Q in FIG. 4.

FIGS. 4 and 5 show another embodiment, which is different from the above described embodiment only in the following members. That is, a connecting piece 27 connects the folded-back parts of the respective elastic leg pieces 16 and 17 and interferes with the respective elastic leg pieces 16 and 17 in case the thicknesses or widths of the elastic leg pieces 16 and 17 are different and the elasticity coefficient of the elastic leg pieces 16 and 17 become nonuniform, so that any rolling movement of the piston body 3 due to independent and nonuniform flexures of the elastic leg pieces 16 and 17 will be prevented from occurring and the motion of the piston rod 9 will be stabilized. Coupling pieces 28 are arranged respectively on both right and left sides of the supporting members 6 and 7 between the both fixing pieces 2 and, further, forked elastic projecting pieces 29 are molded as integrally connected in the middle parts of these coupling pieces 28. These elastic projecting pieces 29 and coupling pieces 28 are injection-molded together with the driver 1 in the form shown by the double-dotted chain lines in the drawing and then the coupling pieces 28 are turned as shown by the solid lines so that the tips of the respective elastic projecting pieces 29 will be in elastic contact with both side surfaces of the supporting members 6 and 7. The elastic arm 18 having the shaft bearing 21 at the one end and flexible only in the right and left directions so as to absorb the other motion components than those in the axial directions of the piston 9 is formed of a plurality of parallelly arranged filmy elastic pieces 19 which are thined close to the injection-molding limit and, by thus making them thin, the bending resistance to the flexure in the right and left directions is made as small as possible. The piston body 3 of which the elastic-leg bases 4 and 5 at the front and rear ends are connected to the fixing pieces 2 through the elastic leg pieces 16 and 17 U-shaped in the vertical plane reciprocates to move the piston 9 within the cylinder 14 while being subjected to a resistance to the rolling by the elastic projecting pieces 29 elastically contacting with the supporting members 6 and 7 on the both side surfaces. As the elastic arm 18 is formed of the elastic pieces 19, even if the elastic pieces 19 are made plural so as to be responsive to various loads, the bending resistance in the right and left directions will be reduced so as to render the arm to be more easily flexible and, as a result, even a high speed rotation can be sufficiently followed while unnecessary motion components are absorbed, whereby the rolling applied to the piston rod 9 is reduced and the life of the sealing between the piston rod 9 and the cylinder 14 is prolonged.

Figure 6:
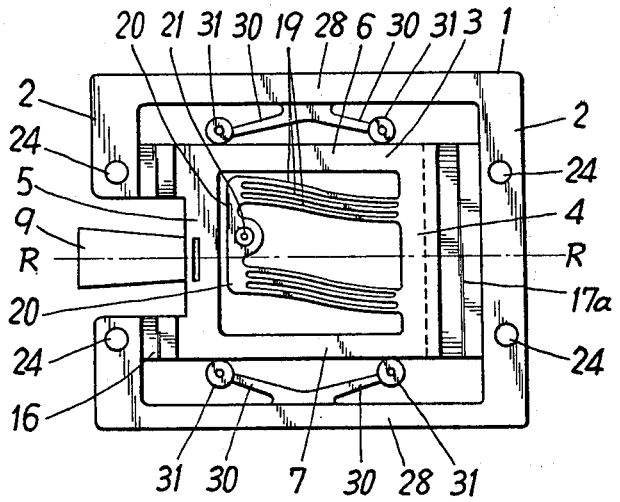
FIG. 6 is a plan view of another embodiment of the drive.
Figure 7:
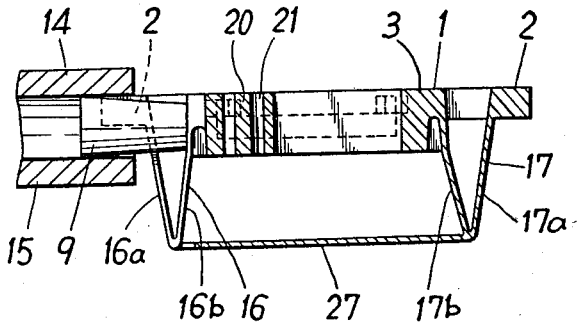
FIG. 7 is a sectioned view on line R—R in FIG. 6.

FIGS. 6 and 7 show another embodiment, which is different from the above referred embodiment only in the following members.

That is, a pair of coupling pieces 28 provided to bridge between the side ends of the both fixing pieces 2 are integrally molded so as to be little elastic, and such rotors 31 as a miniature bearing rotationally contacted with the side surfaces of the supporting members 6 and 7 are mounted to the respective tips of forked projecting pieces 30 extended substantially out of the central parts of these coupling pieces 28. These rotors 31 act as a guide for the reciprocating motions of the movable piece 3 so as to prevent the rolling of the piston body 3 and piston rod 9 without increasing the load, whereby a more accurate reciprocating motions are secured and the life of the sealing between the piston rod 9 and the cylinder 14 can be remarkably prolonged.

Figure 8:
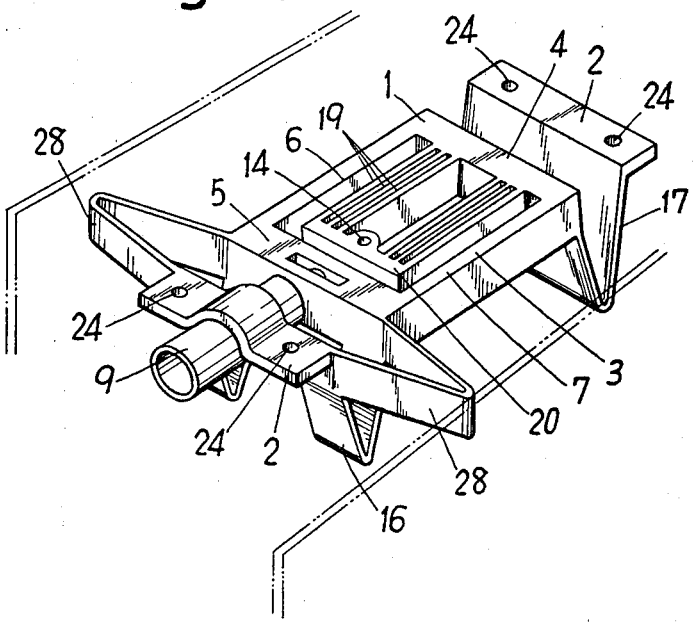
FIG. 8 is a perspective view of an appearance of another embodiment of the driver.
Figure 9:
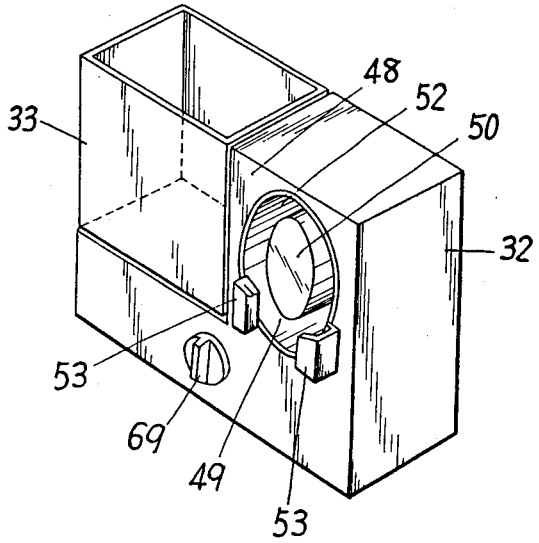
FIG. 9 is a perspective view of an appearance of a mouth washer incorporating the pump driving mechanism of the present invention.
Figure 10:
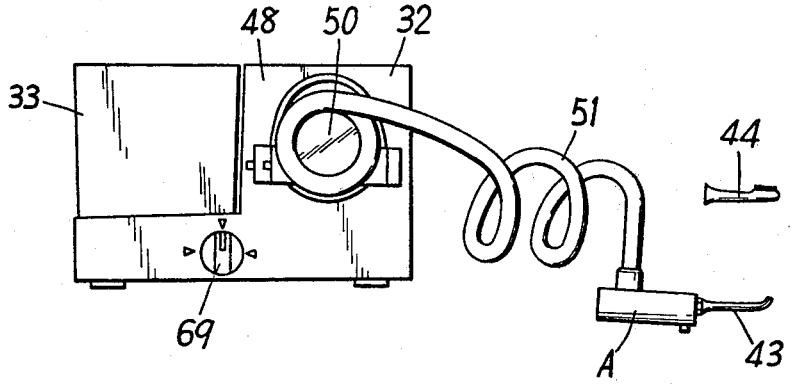
FIG. 10 is a view showing a state in which the mouth washer is used.

In FIG. 8, still another embodiment is shown, in which a pair of elastically flexible coupling pieces 28 U-shaped in a horizontal plane are provided respectively between the side ends of the piston body 3 and the side ends of the fixing piece 2 in addition to the elastically flexible elastic leg pieces 16 and 17 U-shaped in the vertical plane between the front end of the piston body 3 and the fixing piece 2, so that the rolling of the piston body 3 will be prevented by the coupling pieces 28. In this case, the outside surfaces of bent parts projecting sidewise of the coupling pieces 28 are preferably guided by a base 26.

Figure 1:
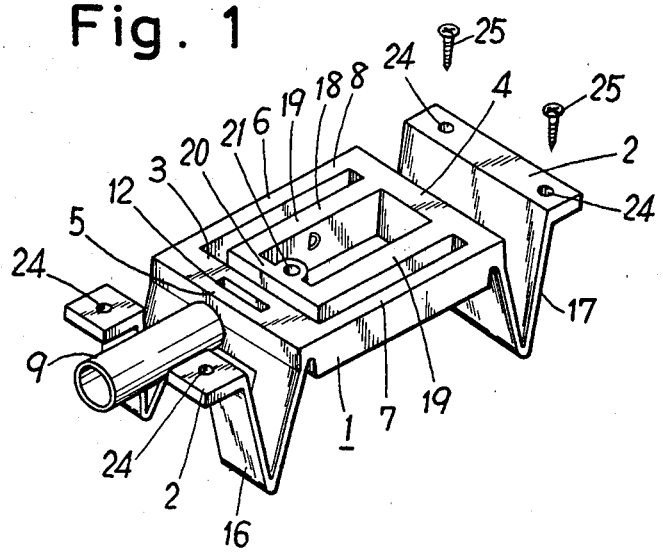
FIG. 1 is a perspective view of an appearance of the drive.
Figure 2:
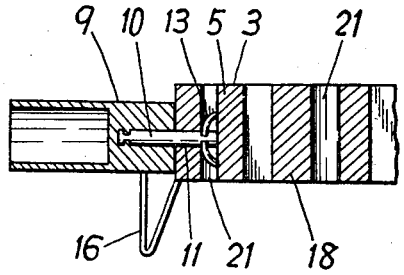
FIG. 2 is a sectioned view on line P—P in FIG. 1.
Figure 14:
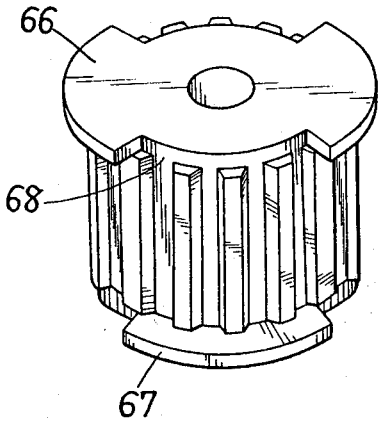
FIG. 14 is a magnified perspective view of a timing pulley.
Figure 11:
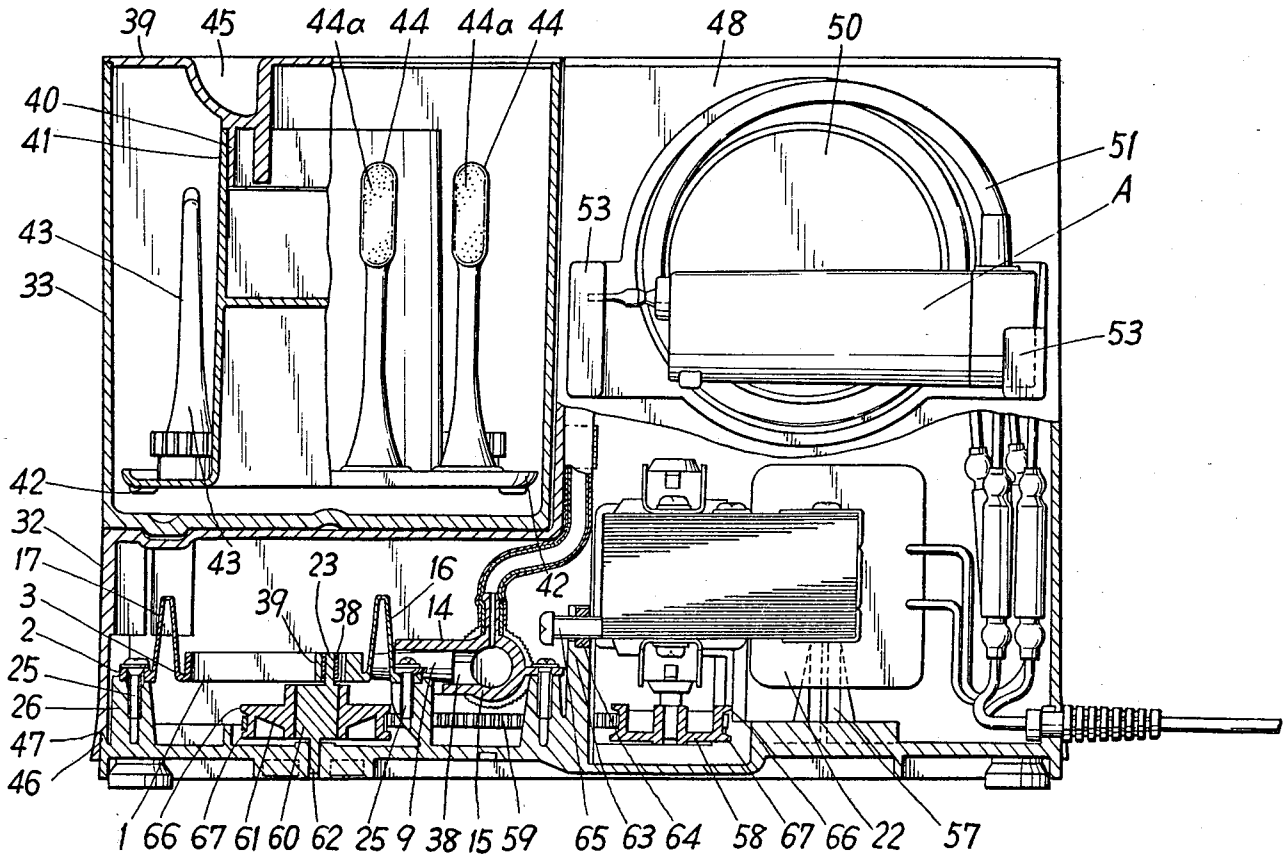
FIG. 11 is a sectioned elevation of the mouth washer.
Figure 12:
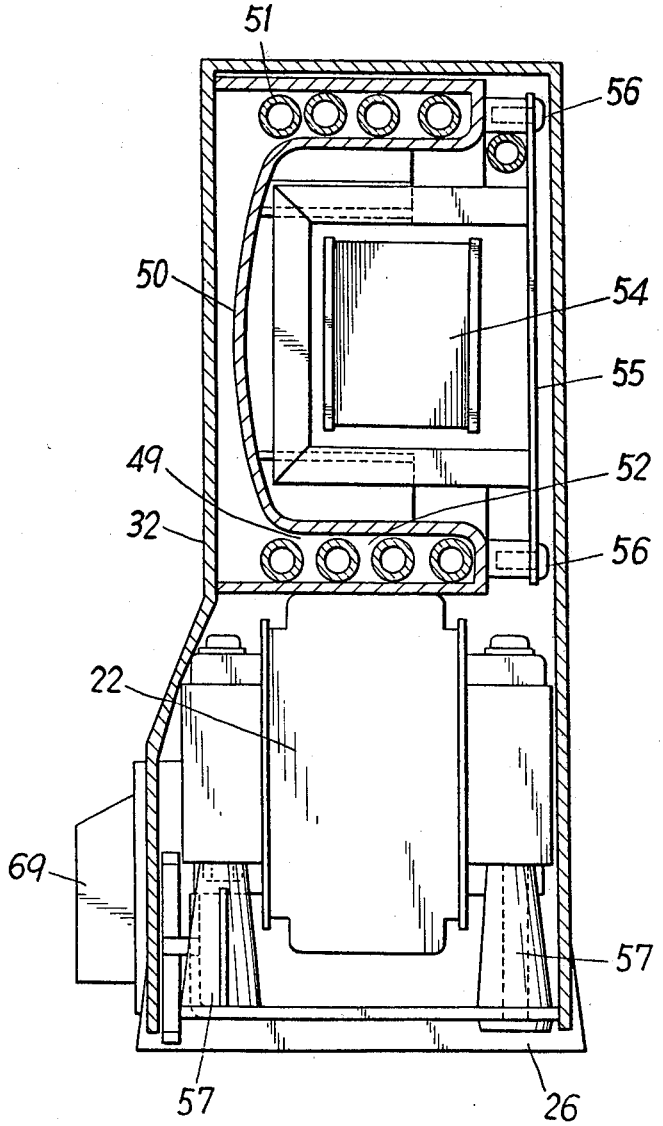
FIGS. 12 and 13 are sectioned side views of the mouth washer.
Figure 13:
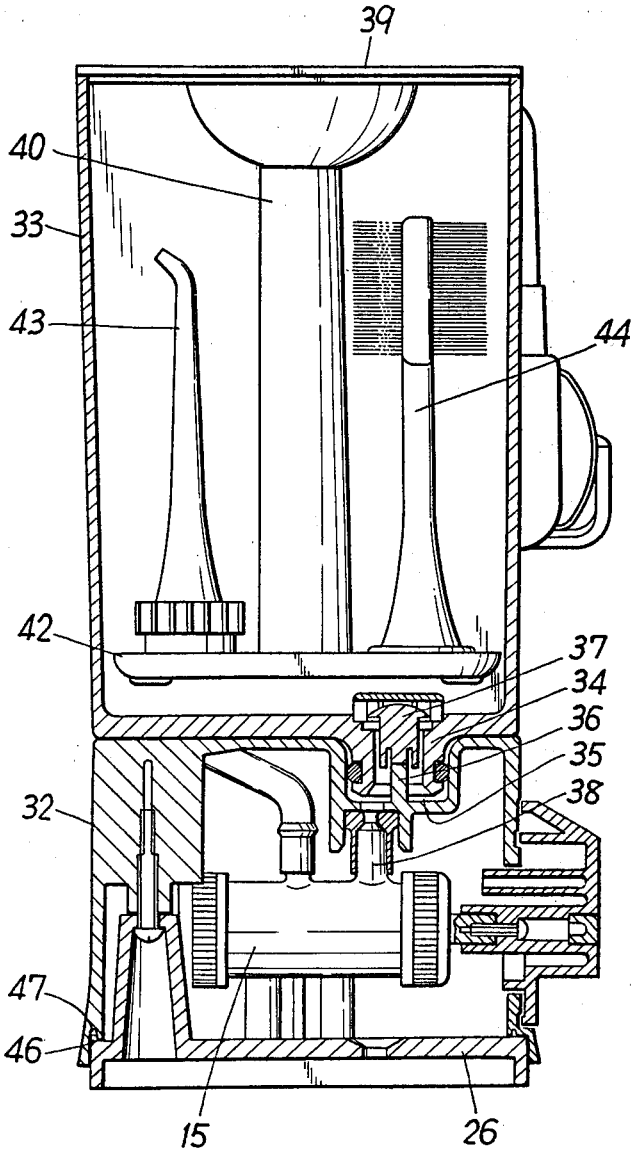
Figure 15:
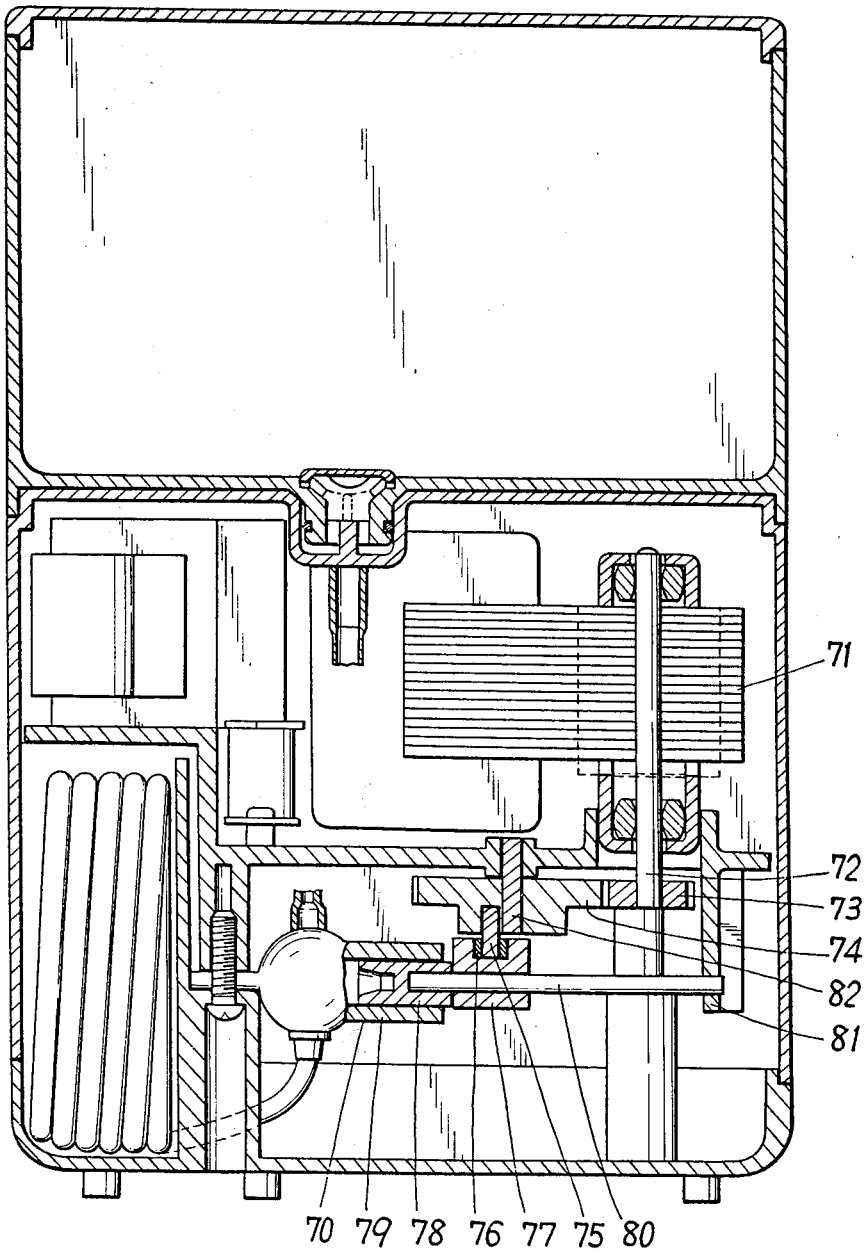
Fig. 15 PRIOR ART
FIG. 15 is a sectioned view showing a conventional water feeding device.

With reference to FIGS. 9 to 13, an embodiment of a mouth washer in which a pump using the driver of FIG. 1 is incorporated shall be explained. A case body 32 containing driving parts and others is recessed in the left shoulder part so that a tank 33 for storing water can be removably mounted on this part. The tank 33 is formed in a rectangular box shape opened on the upper surface and is contained in the case body 32 by fitting a valve tube 34 projecting out of the lower surface into a water feeding port 35 so that, by pushing up a valve 37 with a pin 36 projecting out of the water feeding port 35, the water within the tank 33 will be led into a suction port 38 of a reciprocating piston type pump 15 set below the tank 33 through the water feeding port 35. A lid 39 is to removably cover the upper surface opening of the tank 33, and a tubular shaft 41 is fitted to the lid 39 by fitting the upper end of the tubular shaft 41 onto a projecting tube 40 projected substantially in the center of the lower surface of the lid 39. The tubular shaft 41 is formed to be tapered with the outer diameter smaller toward the upper end and a radially expanding receiving dish 42 is formed on the outer periphery at the lower end, so that a nozzle 43 and tooth brushes 44 can be mounted as erected on the receiving dish 42. Here, the inner surface of the side wall of the tank 33 is also expanded upward so that, when the lid 39 is fitted to the tank 33 to house the receiving dish 42 in the lower part of the tank 33 as shown in FIG. 11, a clearance between the tubular shaft 41 and the tank 33 will be wider in the upper end part a than in the lower end part b, the nozzle 43 and tooth brushes 44 will not contact the tubular shaft 41 and tank 32, particularly, even if the tooth brushes 44 rotate, brush bristles **44*a* will not contact the tubular shaft 41 and, when they are not used, they can be sanitarily contained in the tank 33. A recess 45 is provided annularly on the upper surface of the lid 39 so that the lid 39 will be removed and fitted by inserting fingers into this recess 45. A pump 15 and motor 22 are fitted respectively to a base 26 fitted to an opening on the lower surface of a tube body 32. The base 26 watertightly connects the base plate 26 and case body 32 by fitting a projection 46 projecting upward from the peripheral edge into a groove 47 in the lower end surface of the peripheral edge of the case body 32 in a so-called faucet type. A circular recess 49 opened on the front surface of the case body 32 is provided in a projecting part 48 in the upper part of the case body 32. A tube body 50 closed on the front surface and opened on the rear surface inside the case body 31 is projected forward substantially from the center of the bottom wall of the recess 49 located deeply inside the case body 32. A forward and rearward long annular housing chamber 52 of a diameter substantially equal to the coil diameter of a curled hose 51 is formed between the inner peripheral wall of the recess 49 and the outer peripheral wall of the tube body 50. The curled hose 51 pulled out of the lower part of the inner bottom wall of the housing chamber 52 is to be wound on the outer periphery of the tube body 50 and housed in the housing chamber 52. Thus the curled hose 51 wound to be in a coil shape is housed in the housing chamber 52 provided to be recessed within the case body 32 with the axis of the coil directed in the front and rear directions. Thus, the direction in which the curled hose 51 extends and the direction in which the user actually removes a gripping part A from a holding part 53 coincide with each other. Also, the elongation of the curled hose 51 thus becomes maximum, and the operatability improves, i.e., it will be easy to use even if the case body 32 is arranged in, for example, the inner part of a toilet table. Furthermore, as the curled hose 51 can be housed in the housing chamber 52 recessed within the case body 32, the volume of the entire device including the hose 51 or particularly the width in the front and rear directions can be made smaller. A current source transformer 54 is housed within the tube body 50 opened on the rear surface into the case body 32. The motor 22 is housed below the recess 49 and the pump 15 is housed in the case body below the tank 33 so that, by arranging these three bulky parts 54, 22 and 15 in an L-shape in a vertical plane, the front and rear width and right and left width of the case body 32 can be made as small as possible within a range of allowance. A lid 55 is fitted to the rear surface of the case body 50 by means of screws 56 as shown in FIG. 12 waterproof packing (not illustrated) such as an O-ring is fitted over the entire periphery of butting part between the lid 55 and the tube body 50 to watertightly close the tube body 50, and all such other electric parts as the current source transformer 54 and the like than the motor 22 are fitted en bloc on a printed base board (not illustrated) and are housed in this case body 50. Load wires (not illustrated) for electrically connecting these electric parts and the pump 15 or gripping part A are pulled out of the case body 50 through waterproof bushes (not illustrated) provided at one place of the joint of the tube body 50 and lid 55 so that the electric parts within the tube body 50 will be protected from an entry of water and any short-circuiting due to water entering the tube body 50 can be prevented from occurring even if the case body 32 is all wet while the electric current is being passed. The motor 22, set on a supporting beam 57 projecting out of the base 26 of the case body 32, rotates a timing pulley 58 on the driving side arranged adjacent the base 26 of the case body 32. A timing belt 59 engaging with this timing pulley 58 rotates a timing pulley 61 on the driven side rotatably supported by a shaft 60 on the base 26 below the tank 33 and placed on the same plane as the timing pulley 58. The eccentric shaft 23 projecting above the shaft 60 supported at shaft part 62 by the base 26 drives the piston body 3, and the pump 15 is driven by a conversion of the motion component rendering the rotary motion to be the linear reciprocating motion by the piston body 3. A partition plate 63 is erected from the base 26 between the motor 22 and pump 15, and an adjusting screw 65 is screwed from the side of the pump 15 into an inserted nut 64. The tip of the adjusting screw 65 contacts the motor 22 to press it rightward in FIG. 11, whereby the position of the timing pulley 58 on the driving side for the timing pulley 61 on the driven side is finely adjusted to keep the tension of the timing belt 59 proper, to prevent any tooth skipping, resonance, pulley disengagement and the like from being caused due to any looseness of the timing belt, and to prevent the motor load from being increased due to any over tightness of the belt. Further, this adjusting screw 65 prevents the motor 22 from being moved to the loose side of the timing belt 59 by a dropping shock. The both timing pulleys 58 and 61 engaging with the timing belt 59 for transmitting the driving power between the motor 22 housed on the righthand side of the case body 32 and the pump 15 housed on the lefthand side are provided on the upper and lower end surfaces respectively with upper and lower flanges 66 and 67 to prevent the timing belt 59 from being disengaged. The upper and lower flanges 66 and 67 projecting in the peripheral direction are divided respectively in a plurality of sections by incisions 68 so that, as shown in FIG. 14, the lower flange 67 will be formed within the angle of the incision 68 of the upper flange 66 and the upper flange 66 will be formed within the angle of the incision 68 of the lower flange 67**.

The pump 15 having received the power of the motor 22 through the timing belt 59 feeds the water within the tank 33 to a nozzle 43 fitted to the tip of the gripping part A through the curled hose 51 and an intermittent jet water stream jetted out of the nozzle body 43 washes the mouth. The tooth brush 44 is also fitted to the gripping part A so that, in this case, the tooth brush 44 will be driven by a motor (not illustrated) within the gripping part A so as to function as a so-called electric tooth brush. This motor within the gripping part A is electrically connected to the current source transformer 54 through current source wires formed integrally with the curled hose 5. 69 is a hydraulic pressure adjusting knob for adjusting the pressure of water jetted out of the nozzle.

With the device wherein thus the motor and pump are separated from each other and the timing belt is used to transmit the power between them can be made to be of a thin type in which any restrictions to the arrangement of the driving parts are made less and the substantial depth can be determined only with the width of the motor while the height can be controlled. As the pump is arranged just below the tank, further, the pump and tank can be connected directly with each other so that the parts for the internal water path for which waterproofness must be considered can be reduced. Further, as the timing belt is used to transmit the power, the operation can be made smooth, a high hydraulic pressure can be obtained without involving any slipping and a high performance can be maintained.

We claim:

1. A driving mechanism for a fluid pump of the type comprising a fluid-conducting cylinder, said driving mechanism comprising:

a pair of elastically flexible generally U-shaped leg means, each including first and second legs which flex toward and away from each other about a bend at which said first and second legs are joined, said first leg of each leg means being fixed at a free end thereof, with the free ends of said second legs opposing each other, a piston body coupled to said free ends of said second legs so as to be reciprocable in a fore-aft direction between said fixed free ends of said first legs, said piston body comprising a rigid generally rectangular shaped frame having opposing ends spaced in said fore-aft direction, a piston rod connected to said piston body and arranged to be reciprocable in said cylinder in a direction parallel to said fore-aft direction for pumping fluid through said cylinder, and elastically flexible arm means connected to said frame and disposed therewithin, said arm means including means connectible to an eccentric motor-driven shaft, said arm means being elastically flexible in directions transversely of said fore-aft reciprocable direction and being arranged to transmit motion to said frame in said fore-aft direction.

2. Apparatus according to claim 1, wherein said first and second legs are of substantially equal length.

3. Apparatus according to claim 1, wherein said frame includes side portions spaced apart in said transverse direction, and guide means connected to said fixed legs and arranged to exert guiding forces on said side portions to resist movement of said frame in said transverse direction.

4. Apparatus according to claim 1, wherein said piston rod is coplanar with said frame.

5. Apparatus according to claim 4, wherein said first leg of one of said leg means includes a recess through which said piston rod extends.

6. Apparatus according to claim 1 including said drive motor having an outlet shaft extending parallel to said eccentric motor-driven drive shaft, a first timing pulley coupled to said outlet shaft, a second timing pulley coupled to said eccentric shaft, and a timing belt drivingly interconnecting said first and second pulleys.

7. Apparatus according to claim 6, wherein said leg means project beyond the plane of said frame in one direction, said timing belt being spaced from the plane of said frame in the opposite direction.

8. Apparatus according to claim 1, wherein said arm means comprises a pair of parallel arms, each arm comprising a plurality of parallel spaced apart arm pieces to maximize the flexibility of said arm means in said transverse direction, and a transverse member interconnecting the free ends of each arm.

* * * * *